US011316259B2

(12) United States Patent
Ai

(10) Patent No.: US 11,316,259 B2
(45) Date of Patent: Apr. 26, 2022

(54) END PLATE ASSEMBLIES FOR BASE STATION ANTENNAS, METHODS FOR MANUFACTURING THE SAME AND RELATED BASE STATION ANTENNAS

(71) Applicant: CommScope Technologies LLC, Hickory, NC (US)

(72) Inventor: Bin Ai, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/246,902

(22) Filed: May 3, 2021

(65) Prior Publication Data

US 2021/0257721 A1 Aug. 19, 2021

Related U.S. Application Data

(63) Continuation of application No. 16/728,398, filed on Dec. 27, 2019, now Pat. No. 11,038,261.

(30) Foreign Application Priority Data

Jan. 3, 2019 (CN) ..... 201910002968.0
Apr. 4, 2019 (CN) ..... 201910268243.6

(51) Int. Cl.

| | |
|---|---|
| ***H01Q 1/12*** | (2006.01) |
| ***H01Q 1/24*** | (2006.01) |
| *H01Q 1/42* | (2006.01) |
| *H01Q 15/14* | (2006.01) |

(52) U.S. Cl.

CPC ..... *H01Q 1/246* (2013.01); *H01Q 1/1207* (2013.01); *H01Q 1/42* (2013.01); *H01Q 15/14* (2013.01)

(58) Field of Classification Search

CPC ..... H01Q 1/246; H01Q 1/1207
USPC ..... 343/878
See application file for complete search history.

(56) References Cited

U.S. PATENT DOCUMENTS

| | | | | |
|---|---|---|---|---|
| 2005/0030250 | A1 | 2/2005 | Gottl et al. | |
| 2012/0020183 | A1* | 1/2012 | Loi | G06K 19/0675 367/2 |
| 2012/0176294 | A1* | 7/2012 | Kviatkofsky | H01Q 1/422 29/525 |
| 2017/0025766 | A1 | 1/2017 | Su et al. | |
| 2020/0099120 | A1 | 3/2020 | Duan et al. | |

FOREIGN PATENT DOCUMENTS

| | | | |
|---|---|---|---|
| CN | 202797245 | U | 3/2013 |
| WO | 2017165512 | A1 | 9/2017 |

OTHER PUBLICATIONS

"Notification of Transmittal of the International Search Report and the written Opinion of the International Searching Authority, or the Declaration, corresponding to International Application No. PCT/US2019/068655, dated Jul. 1, 2020, 20 pages".
"Picture and description of Admitted Prior Art (1 page)".

* cited by examiner

*Primary Examiner* — Peguy Jean Pierre
(74) *Attorney, Agent, or Firm* — Myers Bigel, P.A.

(57) ABSTRACT

An end plate assembly for a base station antenna includes a dielectric cover member that is connected to a metal bottom plate. The dielectric cover member has a peripheral wall that is configured to enclose an open bottom end of a radome of the base station antenna.

19 Claims, 9 Drawing Sheets

END PLATE ASSEMBLIES FOR BASE STATION ANTENNAS, METHODS FOR MANUFACTURING THE SAME AND RELATED BASE STATION ANTENNAS

CROSS-REFERENCE TO RELATED APPLICATIONS

The present application claims priority under 35 U.S.C. 120 as a continuation of U.S. patent application Ser. No. 16/728,398, filed Dec. 27, 2019, which in turn claims priority to Chinese Patent Application No. 201910268243.6, filed Apr. 4, 2019 and to Chinese Patent Application No. 201910002968.0, filed Jan. 3, 2019, the entire content of each of which is incorporated herein by reference.

FIELD

The present invention generally relates to the field of wireless communication, and more specifically to base station antennas.

BACKGROUND

The mobile communication network comprises a large number of base stations, each of which may include one or more base station antennas for receiving and transmitting radio frequency ("RF") signals. A single base station antenna may include many radiator assemblies, which are also referred to as antenna elements or radiating elements. While cellular operators are now requesting base station antennas that operate in two, three or more frequency bands, cellular operators are maintaining strict requirements on the size of the base station antennas. Thus, there is an increasing challenge in designing base station antennas that meet both the functional and size requirements specified by cellular operators.

Small cell base station antennas often have a cylindrical shape in order to provide omnidirectional coverage in the azimuth plane. These antennas often have a cylindrical radome having an open bottom end, and the remainder of the antenna (the antenna assembly) is mounted on a metal end plate. The radome is placed over the antenna assembly, and the metal end plate encloses the open bottom end of the radome. A mounting bracket may be mounted on an outside surface of the end plate and may be used to mount the small cell antenna on a foundation such as, for example, a utility pole, an antenna tower, a building or the like. Since the end plate structurally supports the antenna assembly, the end plate is made of metal to provide high levels of strength and rigidity. However, particularly in the era of 5G communication, antenna elements may be very sensitive. The large-area metal end plate may have a negative impact on, for example, passive intermodulation ("PIM") distortion, return loss, and/or isolation performance of the base station antenna.

PCT Patent Publication WO 2017/165512 A1 describes a base station antenna, which includes an end cover connected to a radome, where the end cover is formed of fiberglass reinforced plastic. The disclosed base station antenna is mounted to a foundation by means of its radome, and the end cover does not have a structural support function. In addition, the end cover is molded to have a specific through hole arrangement for electrical connectors (e.g., radio frequency ports), and this through hole arrangement is determined at the time of molding.

SUMMARY

According to a first aspect of the present invention, an end plate assembly for a base station antenna is provided that includes a dielectric cover member that is connected to a metal bottom plate. The dielectric cover member has a peripheral wall that is configured to enclose an open bottom end of a radome of the base station antenna.

In some embodiments, the dielectric cover member may include an axial stop that is configured to limit movement of the metal bottom plate in an axial direction, the axial stop projecting radially inward from the peripheral wall of the dielectric cover member.

In some embodiments, the axial stop may comprise at least one of (a) a flange projecting radially inward from the peripheral wall of the dielectric cover member and (b) a plurality of protrusions projecting radially inward from the peripheral wall of the dielectric cover member, where the plurality of protrusions are spaced apart from each other on an inner circumferential surface of the peripheral wall of the dielectric cover member in a circumferential direction of the dielectric cover member.

In some embodiments, the axial stop may comprise: a flange projecting radially inward from the peripheral wall of the dielectric cover member. and a plurality of protrusions projecting radially inward from the peripheral wall of the dielectric cover member, where the plurality of protrusions are spaced apart from each other on an inner circumferential surface of the peripheral wall of the dielectric cover member in a circumferential direction of the dielectric cover member, where the metal bottom plate is clamped between the flange and the protrusions.

In some embodiments, the flange may be a continuous annular member or a plurality of spaced apart flange sections.

In some embodiments, the plurality of protrusions may be uniformly distributed on the inner circumferential surface of the peripheral wall of the dielectric cover member in the circumferential direction.

In some embodiments, an individual protrusion may have an elongated protruding portion extending on the inner circumferential surface of the peripheral wall of the dielectric cover member in the circumferential direction of the dielectric cover member.

In some embodiments, the individual protruding portion has two ends, where one of the ends of the protruding portion includes a rotational stop that limits rotation of the metal bottom plate in the circumferential direction of the dielectric cover member.

In some embodiments, the metal bottom plate may be fixed to the dielectric cover member via fastening members, and the metal bottom plate and the flange respectively have holes for receiving the fastening elements.

In some embodiments, the flange may have a plurality of slots, each of which may overlap with one of the protrusions in the axial direction.

In some embodiments, the dielectric cover member may have holes in the peripheral wall thereof that are configured to receive fastening elements for securing the dielectric cover member to the radome.

In some embodiments, the metal bottom plate may have protruding portions and recessed portions alternating with each other on an edge thereof.

In some embodiments, the protruding portions may be configured to rest against the flange between every two adjacent projections of the dielectric cover member, and are rotatable into channels that are formed between the flange of the dielectric cover member and the respective protrusions.

In some embodiments, the dielectric cover member may be a glass fiber reinforced plastic member, and the metal bottom plate may be made of aluminum or an aluminum alloy.

According to a second aspect of the invention, a base station antenna is provided that includes a radome having an open bottom end, a reflector received within the radome, radiating elements mounted to extend outwardly from the reflector, and an end plate assembly for a base station antenna according to the above-described first aspect of the invention. The end plate assembly encloses the open bottom end of the radome. In some embodiments, the base station antenna may be a small cell base station antenna.

According to a third aspect of the invention, a method for assembling an end plate assembly for a base station antenna is provided in which a metal bottom plate and a dielectric cover member are provided. The metal bottom plate is rested against a flange of the dielectric cover member, where each of the protruding portions of the metal bottom plate is positioned between two adjacent protrusions of the dielectric cover member. The metal bottom plate is rotated relative to the dielectric cover member in a circumferential direction of the dielectric cover member until the protruding portions enter a predetermined position between the flange of the dielectric cover member and the respective protrusions.

In some embodiments, the metal bottom plate and the dielectric cover member may be fixed by means of fastening elements, welding or adhesion.

According to a fourth aspect of the present invention, an end plate assembly for a base station antenna is provided that includes an end plate that is configured to enclose an end opening of a radome of a base station antenna and to be mounted in the end opening. The end plate includes a first external side surface and a second internal side surface opposite to the first side surface. The end plate is constituted by an integral dielectric molded member, and the end plate has a first through hole machined in the molded member. The end plate assembly includes a first fitting and a first connecting element, where the first fitting has a planar section configured to planarly rest against on the second side surface of the end plate, and the first connecting element is configured to pass through the first through hole of the end plate and connect the planar section of the first fitting with a mounting bracket configured to support the base station antenna on the foundation, such that the planar section of the first fitting is pressed against the second side surface of the end plate and the mounting bracket is mounted on the first side surface of the end plate. Since the end plate is made of a dielectric material, it may have a less negative impact on the performance of the base station antenna than a metal end plate. Additionally, the end plate can be widely applied to different base station antennas, and thus is relatively inexpensive.

In some embodiments, the first fitting may have a connecting section configured to mount the end plate assembly in the end opening of the radome.

In some embodiments, the first fitting may be configured in an L shape, where the planar section and the connecting section are respectively constructed to be one of two arms in the L shape.

In some embodiments, the first fitting may be a metal member or a fiberglass reinforced plastic member. For example, the first fitting may be an aluminum sheet stamped member or a cast aluminum member.

In some embodiments, the end plate may be made of glass fiber reinforced plastic. Other plastic materials suitable for machining, which may also be considered, may be thermoplastic plastics, and may also be thermosetting plastics.

In some embodiments, the end plate may have a peripheral wall.

In some embodiments, the peripheral wall may have a notch, and the connecting section of the first fitting is disposed in the notch.

In some embodiments, the end plate may have a circular contour or a rectangular contour.

In some embodiments, the end plate assembly may include the mounting bracket. The mounting bracket may be a component of the end plate assembly, and may also not be a component of the end plate assembly and thus may be mounted on the end plate assembly in an ex post manner.

In some embodiments, the mounting bracket may be made of metal, ceramic or fiberglass reinforced plastic.

In some embodiments, the first connecting element may be a screw. As an alternative, a rivet, an expansion plug, a snap-fit element, and the like may also be considered.

In some embodiments, the planar section of the first fitting may have a through hole, and the mounting bracket may have a hole with an internal thread, wherein the screw may be configured to pass through the through hole of the first fitting and the first through hole of the end plate and engage the internal thread of the hole of the mounting bracket.

In some embodiments, the end plate may have a second through hole machined in the molded member, wherein the second through hole is configured to receive an electrical connector.

In some embodiments, the end plate assembly may include the electrical connector received in the second through hole. The electrical connector may or may not be a component of the end plate assembly.

In some embodiments, the end plate may have a third through hole machined in the molded member and adjacent to the second through hole, where the third through hole is configured to receive a second connecting element for the electrical connector.

In some embodiments, the second connecting element may be a screw, a rivet, an expansion plug, a snap-fit element, or the like.

In some embodiments, the electrical connector includes a flange configured to rest against the second side surface of the end plate and mounted on the second side surface of the end plate by means of the second connecting element.

In some embodiments, the electrical connector may be a 4.3-10 connector or an AISG connector.

In some embodiments, the end plate may have a fourth through hole machined in the molded member, where the fourth through hole is configured to receive a third connecting element for fixing a reflector on the second side surface of the end plate.

In some embodiments, the end plate assembly may include a second fitting having a planar section, where the planar section of the second fitting is configured to planarly rest against the second side surface of the end plate, the third connecting element is configured to pass through the fourth through hole and mount the planar section of the second fitting on the second side surface of the end plate, and the second fitting has a connecting section for connection with the reflector.

In some embodiments, the third connecting element may be a screw, and the planar section of the second fitting may have a hole with an internal thread cooperating with the screw or is provided with a stand-off cooperating with the screw.

In some embodiments, the second fitting may be a metal member or a fiberglass reinforced plastic member. Preferably, the second fitting may be an aluminum sheet stamped member or a cast aluminum member.

In some embodiments, the second fitting may be configured to be an L-shaped or T-shaped member.

According to a fifth aspect of the present invention, a base station antenna is provided that includes a radome having an end opening, a reflector received in the radome, radiating elements mounted to extend outwardly from the reflector, and an end plate assembly according to the above-described fourth aspect of the present invention, where the end plate of the end plate assembly encloses the end opening of the radome and is mounted in the end opening.

In some embodiments, the base station antenna may be a small cell antenna.

In some embodiments, the radome may be made of glass fiber reinforced plastic.

According to a sixth aspect of the present invention, a method for manufacturing an end plate assembly for a base station antenna is provided in which a machinable dielectric molded end plate blank is provided. The end plate blank is machined into an end plate, which step includes machining a first through hole in the end plate blank, and providing a first fitting and a first connecting element.

In some embodiments, the method further comprises the steps of providing a mounting bracket, mounting a mounting bracket on a first side surface of the end plate by means of the first connecting element passing through the first through hole of the end plate, and planarly pressing a planar section of the first fitting against a second side surface of the end plate.

In some embodiments, the method may further comprise the step of molding an end plate blank in a mold before providing the end plate blank.

In some embodiments, the step of "machining the end plate blank into an end plate" may further include: machining in the end plate blank a second through hole for an electrical connector and a third through hole adjacent to the second through hole.

In some embodiments, the method may further comprise the step of mounting the electrical connector on the end plate by means of a second connecting element passing through the third through hole.

In some embodiments, the step of "machining the end plate blank into an end plate" further includes machining in the end plate blank a fourth through hole, which is configured to receive a third connecting element for fixing a reflector on the second side surface of the end plate.

It is also to be noted here that, various technical features mentioned in the present application, even if they are recited in different paragraphs of the description or described in different embodiments, may be combined with one another randomly, as long as these combinations are technically feasible. All of these combinations are the technical contents recited in the present application.

DETAILED DESCRIPTION

Figure 1:
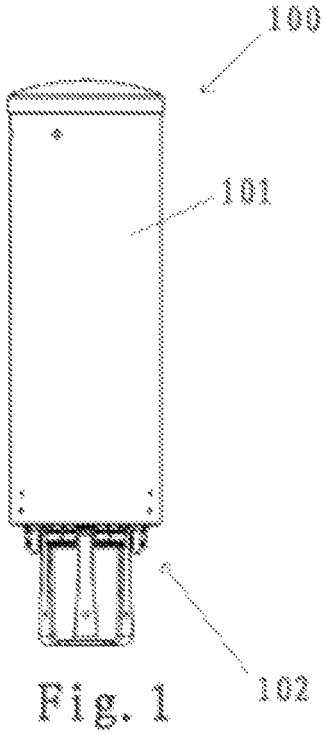
FIG. 1 is a schematic view of a base station antenna according to an embodiment.

FIG. 1 is a schematic view of a base station antenna 100 according to an embodiment of the present invention. The base station antenna 100 may be a small cell base station antenna. The base station antenna comprises a radome 101 having an open bottom end. The radome 101 may be constructed in a cylindrical shape or a cuboid shape or any other shape. The base station antenna may weigh between several kilograms and several tens of kilograms, and preferably may have a weight of less than 10 kilograms.

The base station antenna 100 includes an end plate assembly 102 that encloses the open bottom end of the radome 101. The end plate may be mounted in the open bottom end of the radome 101. The base station antenna 100 may be mounted on a foundation (e.g., a utility pole) by a mounting bracket. A longitudinal axis of the base station antenna 100 may be oriented in the direction of gravity or may also be oriented at an angle to the direction of gravity. The base station antenna 100 may be supported on the foundation by the mounting bracket in a cantilevered manner. The base station antenna 100 may also be additionally and auxiliarily supported at another location. The antenna assembly that is mounted within the radome 101 may include various components such as reflectors, radiating elements, electronic members, cables and the like.

Figure 2:
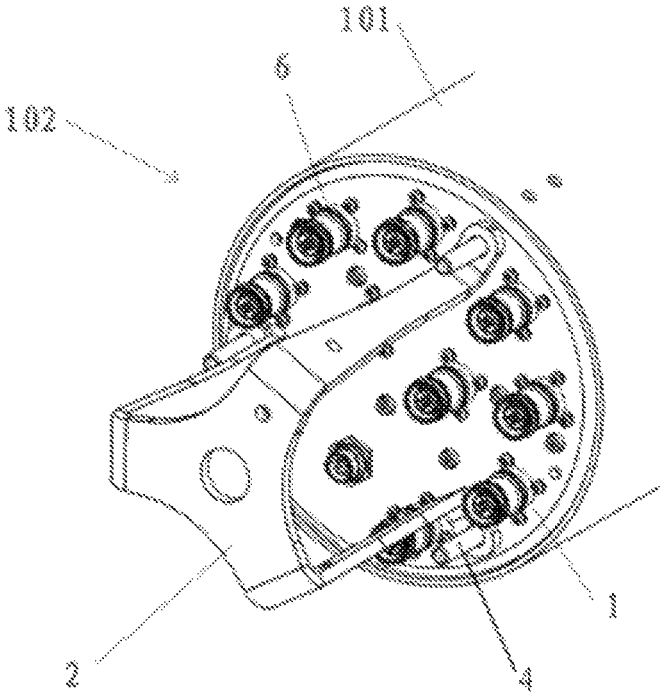
FIG. 2 is a partial perspective view of the base station antenna of FIG. 1.
Figure 3:
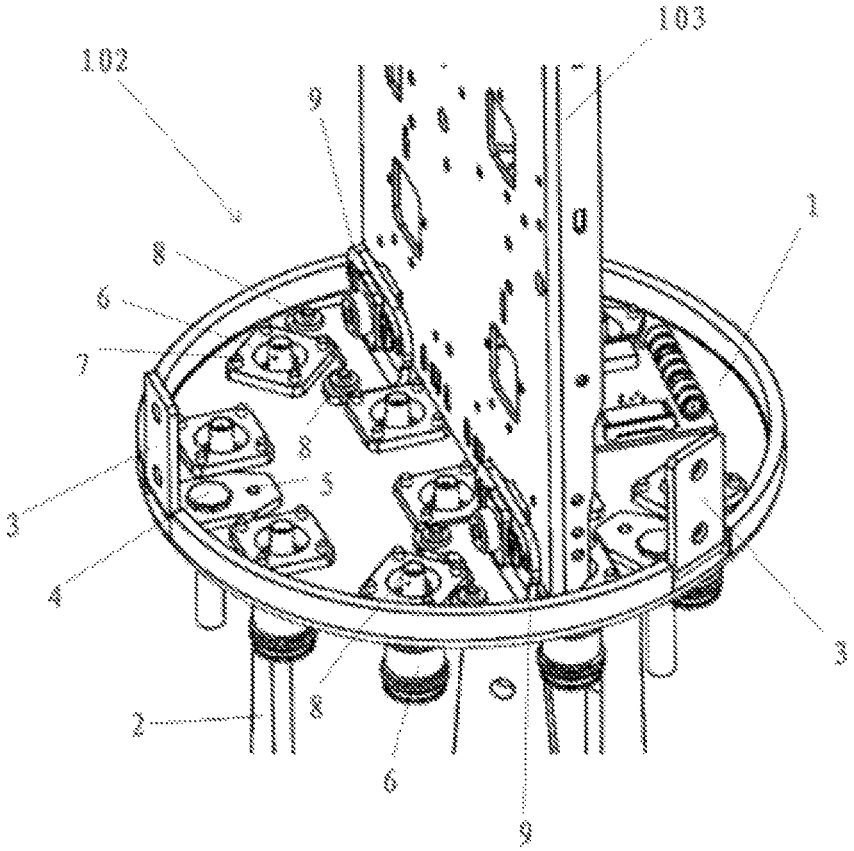
FIGS. 3 and 4 are partial perspective views of an end plate assembly of the base station antenna of FIG. 1.
Figure 4:
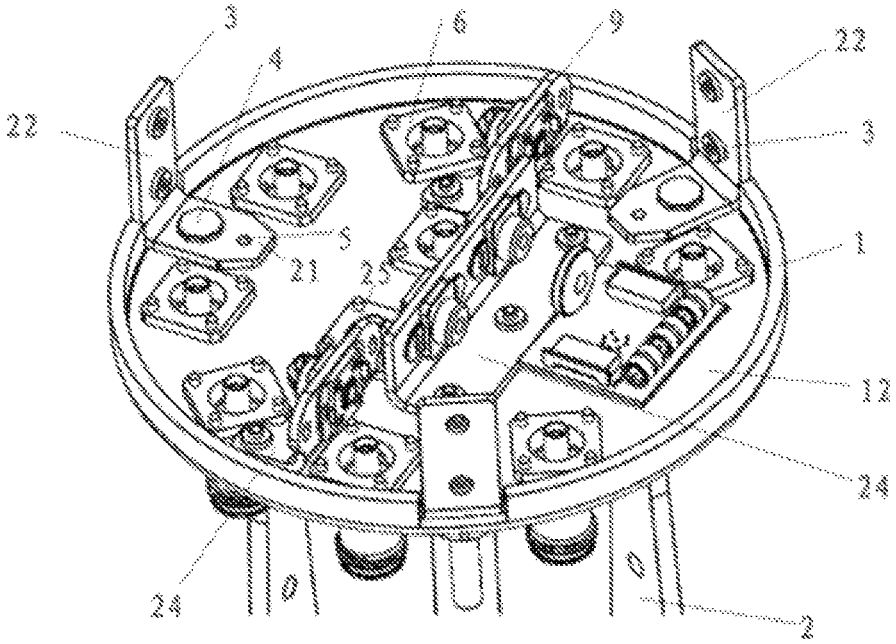
Figure 5A:
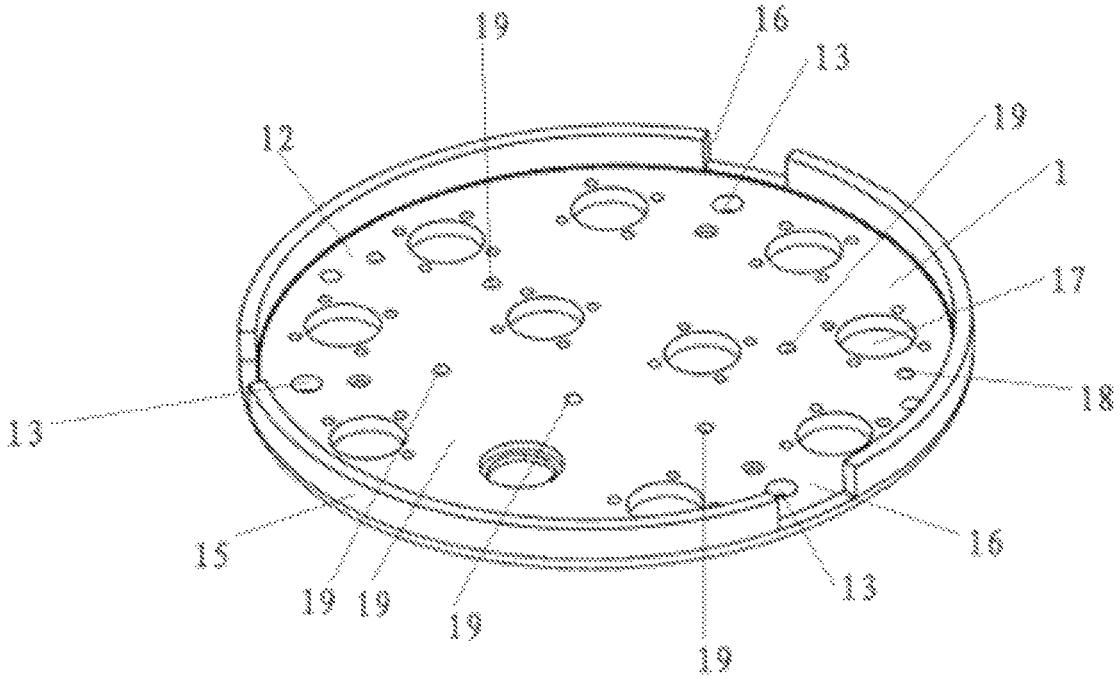
FIGS. 5A and 5B are top and bottom perspective views of an end plate of the base station antenna of FIG. 1, respectively.
Figure 5B:
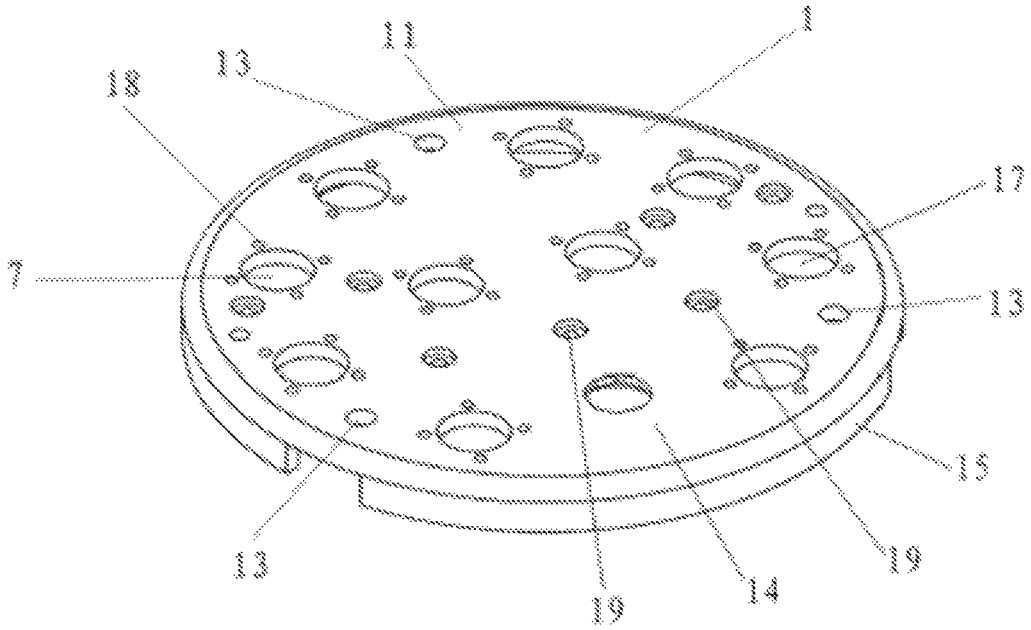

FIG. 2 is a partial perspective view of the base station antenna 100 of FIG. 1. FIGS. 3 and 4 are partial perspective views of the end plate assembly 102 of the base station antenna 100. FIGS. 5A and 5B are top and bottom perspective views, respectively, of the end plate 1 of the end plate assembly 102.

As shown in FIGS. 5A and 5B, the end plate 1 has a first external (bottom) side surface 11 and a second internal (top) side surface 12 that is opposite the first side surface 11. The end plate 1 includes a bottom 14, and a peripheral wall 15 in which a plurality of notches 16 are provided. When the end plate 1 encloses the open bottom end of the radome 101, a seal may be formed between the outer circumferential surface of the peripheral wall 15 and the inner circumferential surface of the radome 101. The contour shape of the end plate 1 corresponds to the shape of the inner circumferential surface of the radome 101. For example, the end plate 1 may have a circular contour, a rectangular contour or a regular hexagonal contour.

The end plate 1 may be a molded member made of a dielectric material, and for example, may be made of fiberglass reinforced plastic. The end plate 1 may be formed by molding an end plate blank in a mold and then machining the end plate blank into the end plate 1. Machining may include, but is not limited to: punching, drilling, cutting, and other machining operations.

The end plate 1 may have a plurality of machined first through holes 13. The mounting bracket 2 is mounted on the first (bottom) side surface 11 of the end plate 1 by means of first connecting elements 4. In the depicted embodiment, the mounting bracket 2 has three legs, each of which has a through hole for receiving a respective first connecting element 4. Three corresponding first through holes 13 are provided in the end plate 1. The through holes in the legs of the mounting bracket 2 may be replaced by blind holes, but such a design may impose strict requirements on the length of the first connecting elements 4. If each leg of the mounting bracket 2 has two through holes for receiving the first connecting elements 4, the number of first through holes 13 in the end plate 1 may be increased to six through holes 13. Other numbers of first through holes 13 are possible. The through hole in each of the legs of the mounting bracket 2 may have internal threads in some embodiments in order to eliminate any need for providing separate nuts for screwing on the external threads of the first connecting elements 4. The mounting bracket 2 may be made of metal, such as aluminum or an aluminum alloy; or may alternatively be made of plastic, such as fiberglass reinforced plastic.

The connecting elements discussed herein may be screws, rivets, expansion plugs or other connecting elements.

As shown in FIGS. 3 and 4, a plurality of first fittings 3 are provided, which, for example, may be made of a metal such as aluminum or an aluminum alloy. It is also possible that the first fittings 3 may be made of plastic such as, for example, fiberglass reinforced plastic. Here, each first fitting 3 is constructed in an L shape with a planar section 21 and a connecting section 22. The planar section 21 planarly rests against the second (top) side surface 12 of the end plate 1 and has a through hole, and the connecting section 22 is disposed in the notch 16 of the end plate 1. The first connecting elements 4 pass through the through holes of the planar sections 21 of the first fittings 3 and the first through holes 13 of the end plate 1 as well as through the through holes in the legs of the mounting bracket 2 in order to attach the mounting bracket 2 on the first side surface 11 of the end plate 1. As is also shown in FIGS. 3 and 4, a pin hole 5 may be provided beside the through hole of each planar section 21. A positioning pin is inserted into each pin hole 5 and may press or project into a recess in the second side surface 12 of the end plate 1, so as to further prevent rotation of the first fittings 3 about the respective first connecting elements 4. The recesses may be machined, or may be formed by the positioning pins when the positioning pins are mounted in the respective pin holes 5. Each connecting section 22 may have at least one through hole with an internal thread, for receiving a screw that is screwed into the through hole from the outer circumferential surface of the radome 101 so as to mount the end plate assembly 102 in the bottom opening of the radome 101. The through holes with the internal threads provided in the connecting sections 22 may be realized, for example, using internally-threaded stand-offs that are pressed into the through hole of the connecting sections 22. As shown in FIG. 4, two stand-offs may be provided in each connecting section 22 in an example embodiment.

The first fittings 3 may have a function of connecting the radome 101 to the end plate assembly 102 and may also have a function of cooperating with the first connecting elements 4. It will be appreciated, however, that these two functions may alternatively be performed by two separate members. For example, the connecting sections 22 may be integral components of the end plate 1, and the planar sections 21 may be separate members.

Figure 6C:
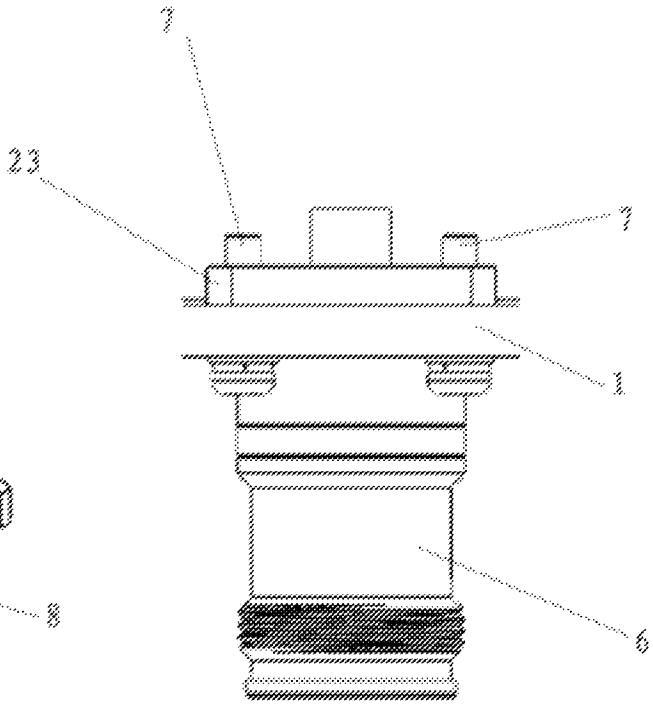
FIGS. 6A to 6C are enlarged views of several individual elements of the base station antenna of FIG. 1.
Figure 6B:
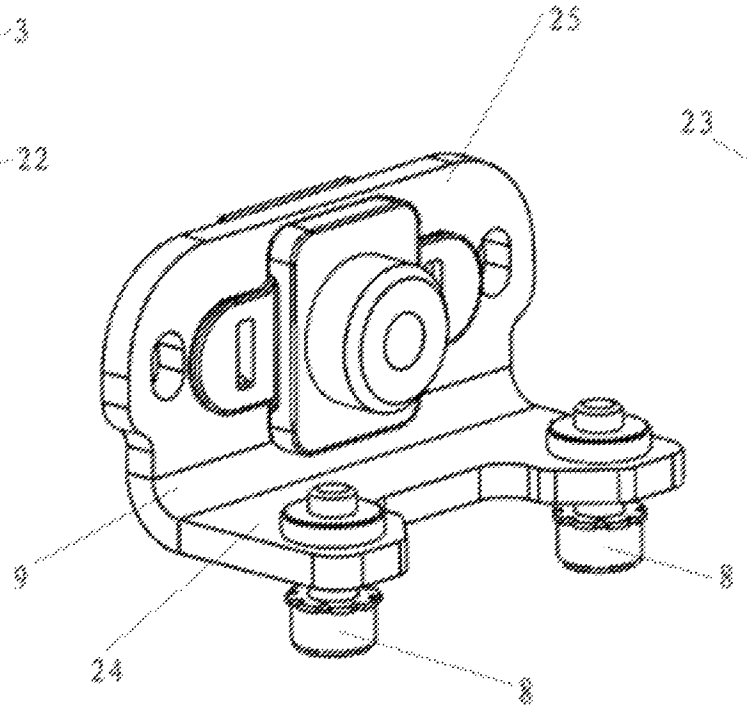
Figure 6A:
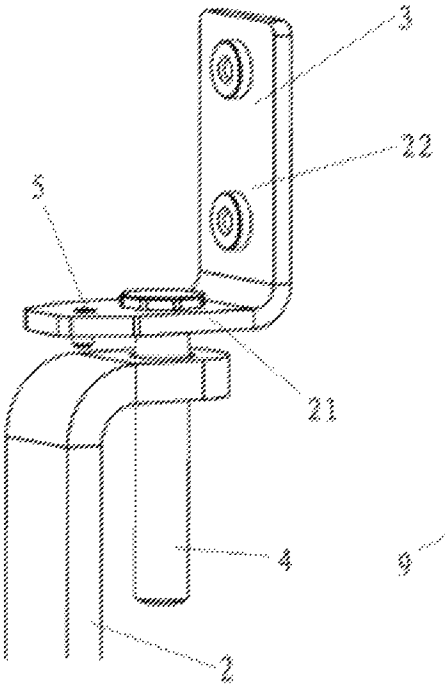

The partial perspective view of FIG. 6A illustrates the connection between a leg of the mounting bracket 2 and one of the first fittings 3 using a first connecting element 4 and a positioning pin in more detail. The portion of the end plate 101 that is clamped between the planar section 21 and the leg of the mounting bracket 2 is omitted in FIG. 6A in order to more clearly illustrate the positioning pin inserted into the pin hole 5. The planar section 21 can dispersedly transmit a force of the first connecting element 4 into the end plate 1, and the planar section 21 can also reinforce the end plate 1. Therefore, the end plate assembly 102 not only may support the entire base station antenna 100, but also can realize better performance, especially in terms of PIM distortion, return loss and isolation performance, as compared to the case of a metal end plate.

The end plate 1 may have machined second through holes 17 and machined third through holes 18 that may surround the respective second through holes 17. Electrical connectors 6 are received in each second through hole 17. Second connecting elements 7 for mounting the electrical connector 6 on the end plate 1 are received in the respective third through holes 18. The size, number and layout of the second through holes 17 and the third through holes 18 may be flexibly realized by machining in the end plate blank according to actual needs.

The installation of a single electrical connector 6 on the end plate 1 in some embodiments is illustrated in a partial detail view in FIG. 6C. The electrical connector 6 may be, for example, a 4.3-10 connector. In addition to the 4.3-10 connector, an AISG connector may also be mounted on the end plate 1. The electrical connector 6 may include a body and a flange 23. The body is received in the second through hole 17 in the end plate 1, and the flange 23 has through holes with internal threads in each of its four corners. The through holes in the flange 23 are aligned with the respective third through holes 18 that surround the second through hole 17, and a second connecting element 7 in the form of, for example, a screw, is received in each through hole of the flange 23 and the underlying third through hole 18.

This connection structure is particularly advantageous. There may be exactly one metal-to-metal contact at each joint, i.e., metal-to-metal contact between the metal of the second connecting element 7 and the metal of the flange 23. A smaller number of metal-to-metal contacts generally correlates with better PIM distortion performance. Further, when it is necessary to service, repair or rework the base station antenna, it is possible to first release each of the first connecting elements 4, and then remove the end plate 1 from the base station antenna 100 without having to disassemble the electrical connectors 6 and associated cables.

The end plate 1 may have fourth machined through holes 19, which receive respective third connecting elements 8 for mounting a reflector 103 on the second (top) side surface 12 of the end plate 1. As schematically illustrated in FIG. 3, the base station antenna 100 may have a single reflector 103 in some embodiments. For the reflector 103, a plurality of fourth through holes 19 are provided in the end plate 1. In addition, a plurality of second fittings 9 are provided. These second fittings 9 may be metal members, such as aluminum sheet stamped members or cast aluminum members; and may also be plastic members, for example be made of fiberglass reinforced plastic.

Here, the second fittings 9 may each have an L shape with a planar section 24 and a connecting section 25. The planar section 24 planarly rests against the second side surface 12 of the end plate 1 and may include one or more through holes with internal threads, which may be realized, for example, by pressing a stand-off into each through-hole. Third connecting elements 8 pass through respective ones of the fourth through holes 19 in the end plate 1 and the through hole of the planar section 24 in order to mount each second fitting 9 on the second side surface 12 of the end plate 1. The connecting section 25 of each second fitting 9 may be connected to the reflector 103 by a connecting element.

A perspective view in which a second fitting 9 together with a third connecting element 8 is illustrated in FIG. 6B. Here, two third connecting elements 8, which are constructed as screws, and two stand-offs are provided in the planar section 24. The number of joints is exemplary, and it is self-evident that more joints may also be provided as needed.

Figure 7A:
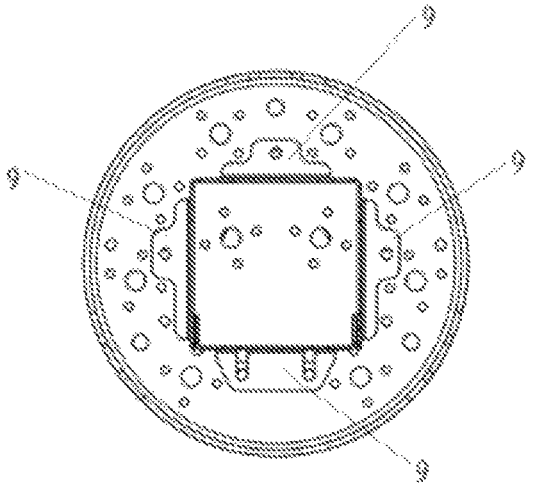
FIGS. 7A and 7B are schematic top views of end plate assemblies according to further embodiments of the present invention.
Figure 7B:
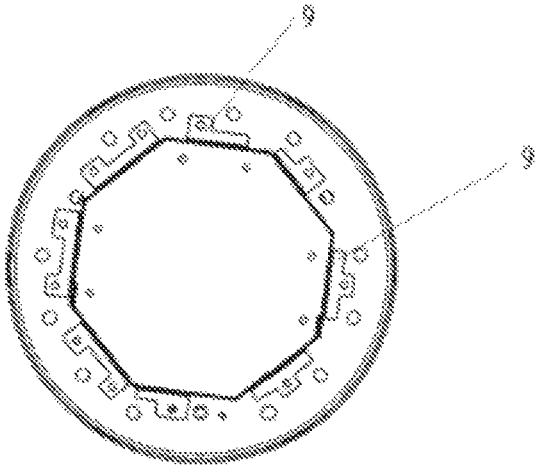

FIGS. 7A and 7B are schematic top views of an end plate assembly 102 according to further embodiments of the present invention. In FIG. 7A, the antenna assembly includes four reflectors 103, and consequently four second fittings 9 are provided, each of which is associated with a respective one of the reflectors 103. Radiating elements of the same or different frequency bands may be provided on each reflector 103. In FIG. 7B, a total of eight second fittings 9 are provided, each of which is associated with a respective reflector 103 of the base station antenna 100. Therefore, the base station antenna of FIG. 7B includes a total of eight reflectors 103. Radiating elements of the same or different frequency bands may be provided on each reflector 103. In other aspects of the base station antenna 100, which are not illustrated in detail in FIGS. 7A and 7B, reference may be made to the previous embodiments accordingly.

In some embodiments, instead of the second fitting 9, the reflector 103 may have a curved or L-shaped end area which planarly rests against the second side surface 12 of the end plate 1 and is mounted to the second side surface 12 by means of the third connecting elements 8.

Figure 8:
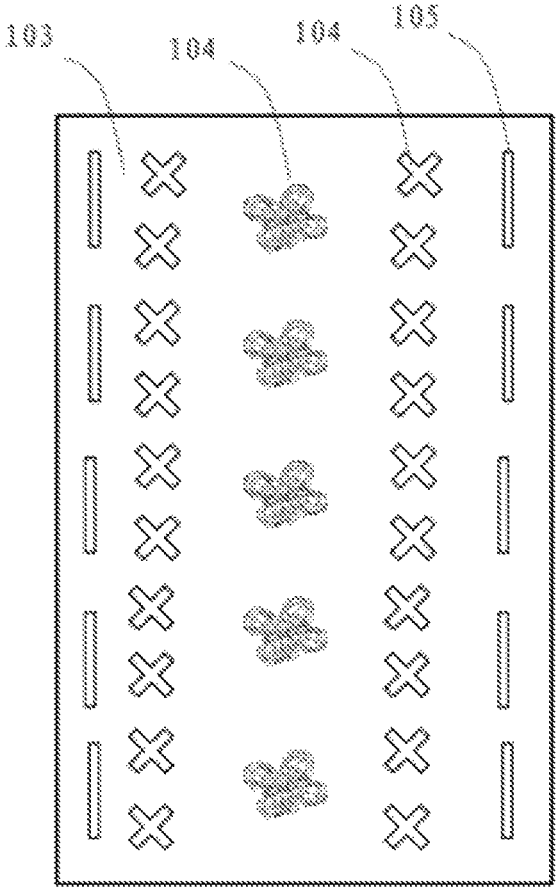
FIG. 8 is a schematic view of the arrangement of radiating elements on a reflector.

FIG. 8 is an exemplary schematic view of the arrangement of the radiating elements 104 on the reflector 103. An array constituted by the same or different radiating elements 104 or to say dipoles may be provided on the reflector 103. An array of parasitic elements 105 for adjusting the performance of the base station antenna may also be provided.

The end plate assembly 102 according to the present invention may be interchangeable with the existing metal end plates. In other words, the other members of the base station antenna may remain unchanged, or it is only necessary to slightly and adaptively change the other members of the base station antenna.

Figure 9A:
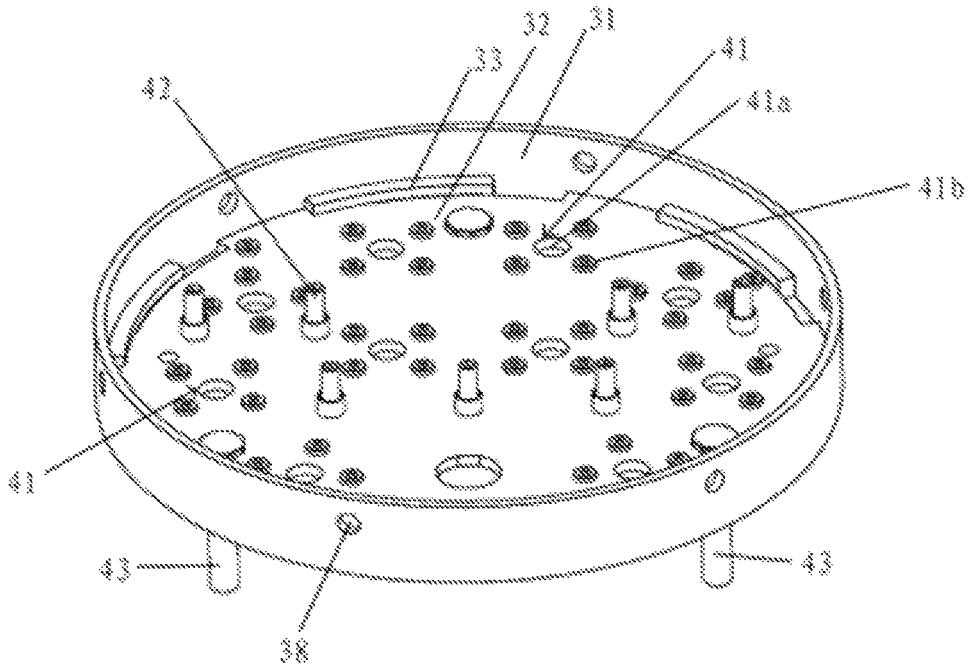
FIGS. 9A and 9B are perspective top and bottom views of an end plate assembly according to other embodiments respectively.
Figure 9B:
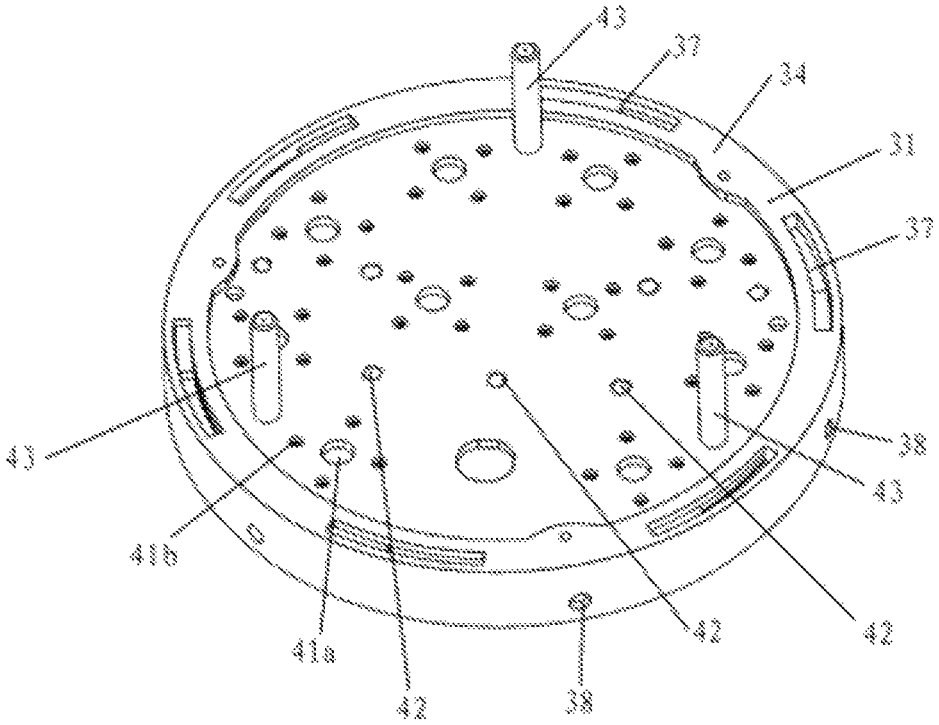
Figure 9C:
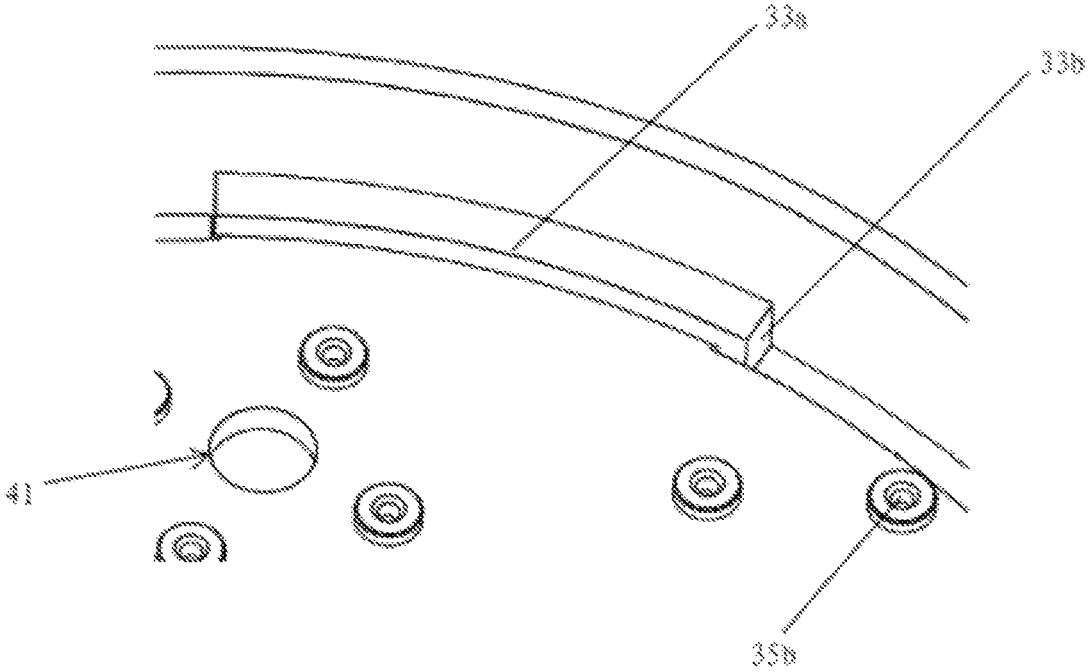
FIGS. 9C and 9D are partially enlarged views of the end plate assembly of FIGS. 9A and 9B respectively.
Figure 9D:
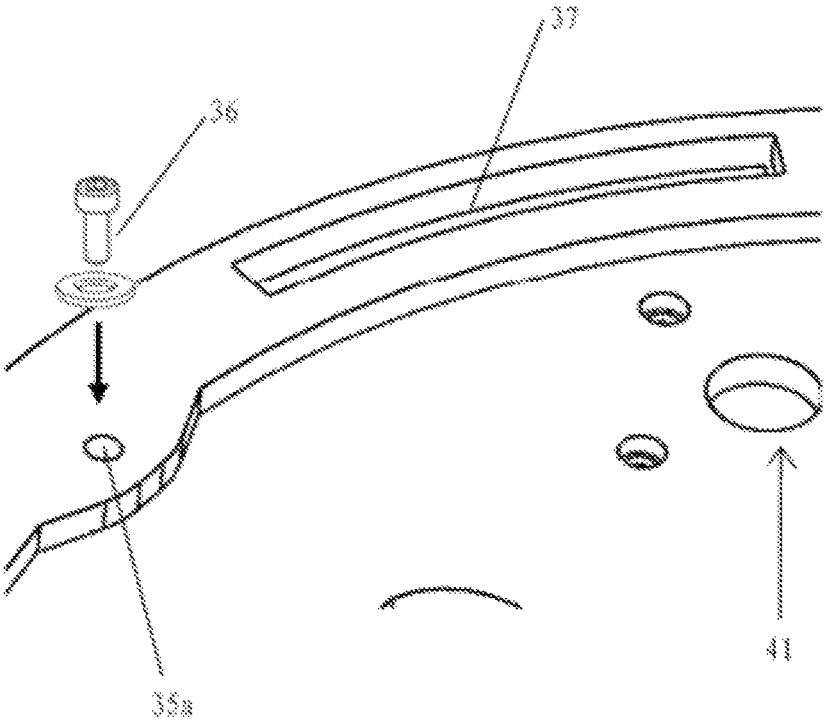

FIGS. 9A and 9B are top and bottom perspective views, respectively, of an end plate assembly according to further embodiments of the present invention, and FIGS. 9C and 9D are partially enlarged top and bottom views, respectively, of the end plate assembly FIGS. 9A and 9B.

In the embodiment shown in FIGS. 9A-9D, the end plate assembly comprises a dielectric cover member 31 that is formed of a dielectric material and a metal bottom plate 32 that is formed of metal. The dielectric cover member 31 may be formed of a plastic such as a glass fiber reinforced plastic in some embodiments. The metal bottom plate 32 may be formed of aluminum or an aluminum alloy in some embodiments. The dielectric cover member 31 has a peripheral wall, and the dielectric cover member 31 can be connected to the metal bottom plate 32. The dielectric cover member 31 may have: a flange 34 projecting radially inward from the peripheral wall, where the flange 34 functions as an axial stop that limits movement of the metal bottom plate 32 in an axial direction; a plurality of protrusions 33 projecting radially inward from the peripheral wall, where the protrusions are spaced apart from each other on an inner circumferential surface of the peripheral wall of the dielectric cover member 31 in a circumferential direction, and the plurality of protrusions also act as an axial stop that limits movement of the bottom plate in the axial direction. The metal bottom plate 32 may be clamped between the flange 34 and the protrusions 33. The flange 34 may be a continuous annular member. In other embodiments (not shown), the flange 34 may also include a plurality of flange sections that are spaced apart from one another in the circumferential direction. The plurality of protrusions 33 may be uniformly distributed on the inner circumferential surface of the peripheral wall of the cover member 31 in the circumferential direction.

An individual protrusion 33 may have an elongated inwardly protruding portion 33*a* that extends on the inner circumferential surface of the peripheral wall in the circumferential direction of the dielectric cover member. The protruding portion may function as an axial stop that limits movement of the metal bottom plate 32 in the axial direction. The protruding portion 33*a* has two ends. One of the ends of the protruding portion is provided with a rotational stop 33*b* that limits movement of the metal bottom plate 32 in the circumferential direction of the cover member 31. The metal bottom plate 32 may be fixed to the dielectric cover member 31 via fastening members 36. The metal bottom plate 32 and the flange 34 may have respective holes 35*a*, 35*b* for receiving the fastening elements 36 in some embodiments. The fastening elements 36 may be, for example, screws or a push rivets.

Figure 11:
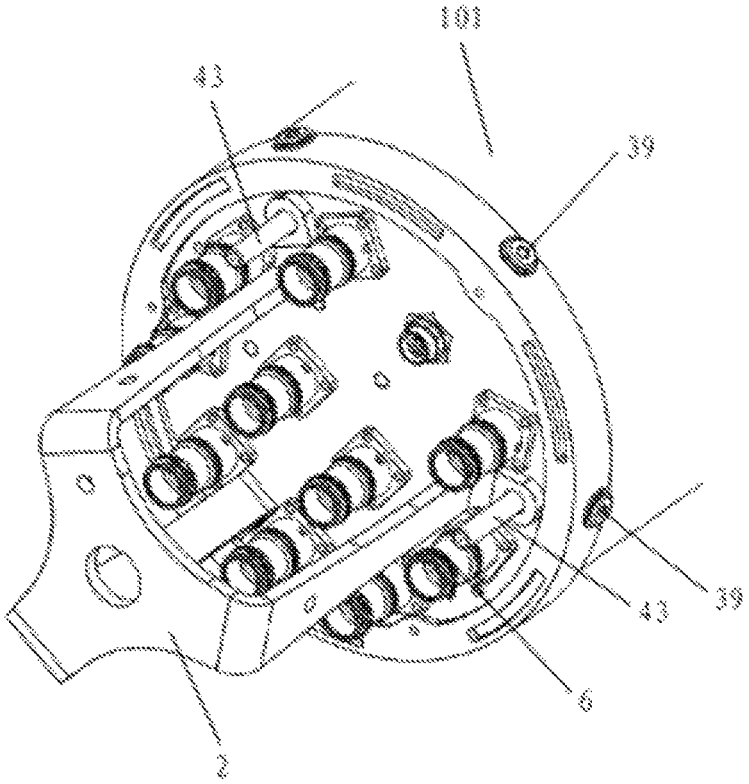
FIG. 11 is a partial perspective view of the base station antenna of FIG. 10.

The dielectric cover member 31 may have a plurality of holes 38 in the peripheral wall thereof, where the holes are configured to receive fastening elements 39 for securing the dielectric cover member 31 to the radome 101, as shown in FIG. 11. The peripheral wall of the dielectric cover member 31 may be configured to be placed onto and/or over an open bottom end of the radome 101 to enclose the open bottom end of the radome. In some embodiments, the peripheral wall of the dielectric cover member 31 may also be configured to be placed into the open bottom end of the radome.

The flange 34 of the dielectric cover member 31 may have a plurality of slots 37, each of which may overlap in the axial direction with one of the protrusions 33 of the dielectric cover member 31. The slots 37 may facilitate forming the protrusions 33 during an injection molding process used to form the dielectric cover member 31.

The bottom of the dielectric cover member 31 may have a central opening that occupies a substantial portion of the cross-sectional area of the dielectric cover member 31. In some embodiments, the bottom of the dielectric cover member 31 may also have tabs that span the central opening.

The metal bottom plate 32 may be prefabricated to include many holes. For example, the metal bottom plate 32 may be prefabricated with a plurality of hole groups 41, each of which may include one hole 41*a* for receiving an electrical connector 6 and a plurality of fixing holes 41*b* positioned around the hole 41*a* for receiving fastening elements which are used for securing the electrical connector 6 to the metal bottom plate 32. The metal bottom plate 32 may be prefabricated with a plurality of second holes for receiving fastening elements 43 that connect a bracket 2 to the bottom plate 32. The metal bottom plate 32 may be prefabricated with a plurality of third holes 42 for receiving fastening elements that secure antenna assemblies of the base station antenna, such as a reflector and a phase shifter to the bottom plate 32. Some of the holes may be provided with stand-offs, into which screws as fastening elements may be screwed.

Figure 12:
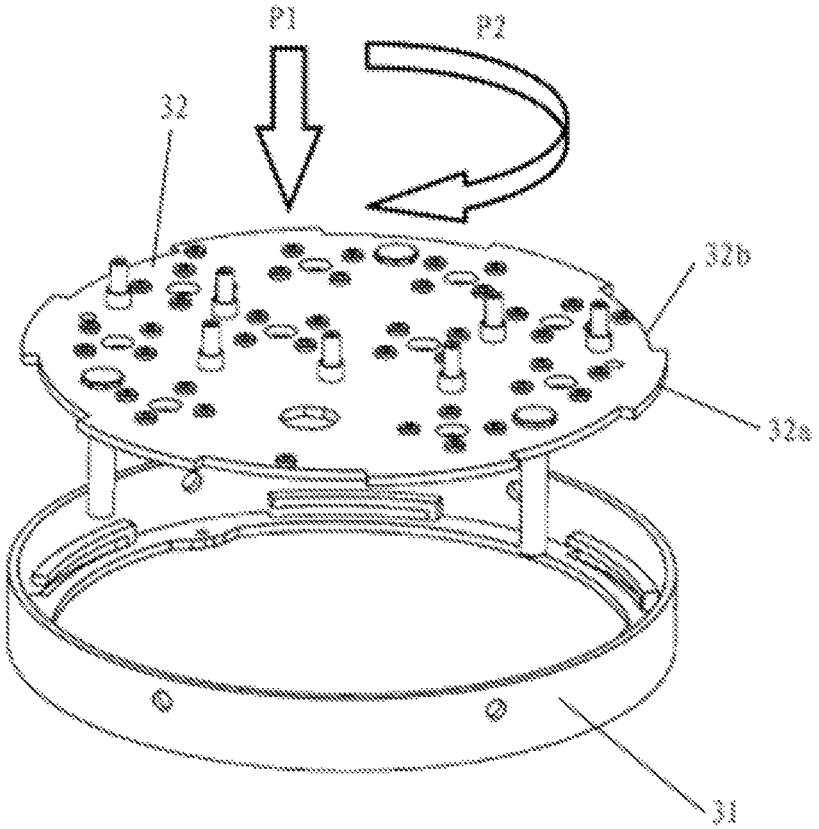
FIG. 12 is a schematic view illustrating a process for assembling the end plate assembly of FIGS. 9A to 9D.

The metal bottom plate 32 may have protruding portions 32*a* and recessed portions 32*b* alternating with each other on an edge thereof (see FIG. 12). The protruding portions 32*a* may be configured to rest against the flange 34 between every two adjacent protrusions 33 of the dielectric cover member 31. The metal bottom plate 32 may be rotated with respect to the dielectric cover member 31 so that the protruding portions 32*a* underlie the respective protrusions 33.

Figure 10:
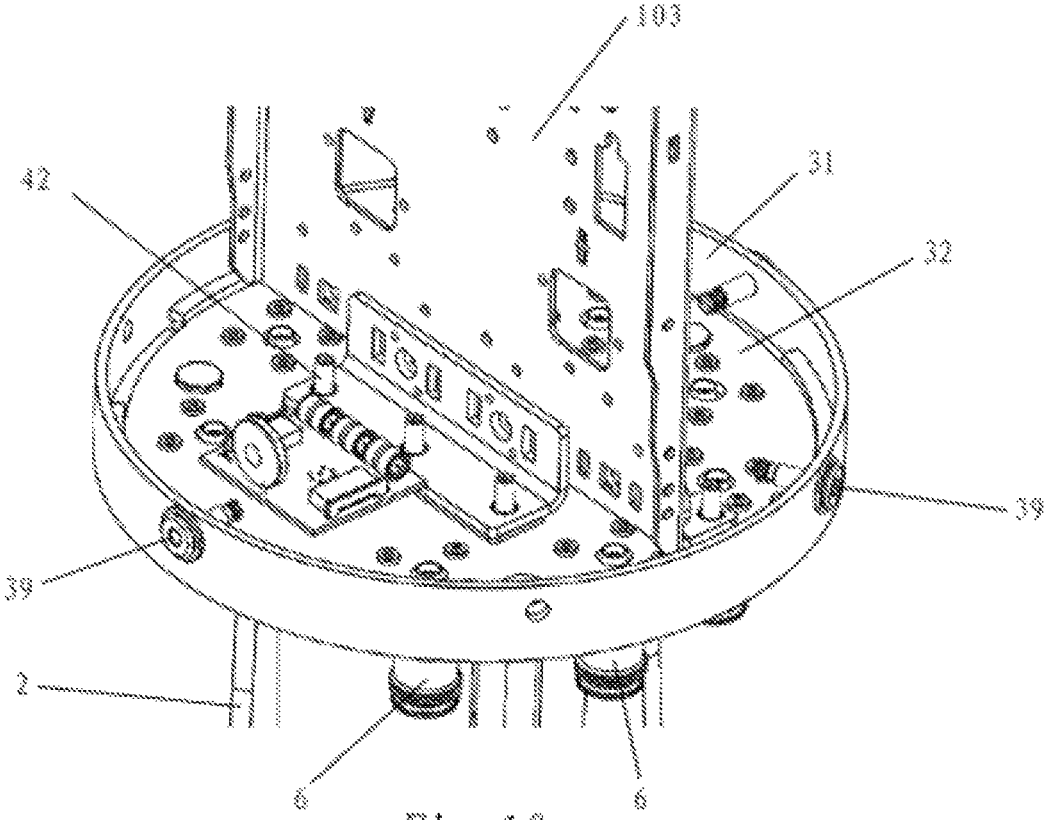
FIG. 10 is an enlarged view of a plurality of individual components of a base station antenna having the end plate assembly of FIGS. 9A-9D.

FIG. 10 is an enlarged view of some individual components of a base station antenna having the end plate assembly as shown in FIGS. 9A-9D, in which the radome of the base station antenna is omitted and the reflector 103 is only partially illustrated. FIG. 11 is a partial perspective view of the base station antenna according to FIG. 10. For example, the base station antenna may be a small cell base station antenna.

FIG. 12 is a schematic view illustrating a process for assembling the end plate assembly as shown in FIGS. 9A to 9D. First, as shown by the arrow p1, the metal bottom plate 32 is rested against the internal surface of the flange 34 of the dielectric cover member 31 so that each protruding portion 32*a* of the metal bottom plate 32 is positioned between two adjacent protrusions 33 of the dielectric cover member 31. Then, as shown by the arrow p2, the metal bottom plate 32 is rotated relative to the dielectric cover member 31 in the circumferential direction, until each protruding portion 32*a* enters a predetermined position between the flange 34 of the dielectric cover member 31 and the respective protrusions 33. Then, as shown in FIGS. 9C and 9D, the fastening members 36 are screwed into the holes 35*a* in the flange 34 and the holes 35*b* in the bottom plate 32 in order to fix the metal bottom plate 32 to the flange 34.

In the embodiment shown in FIGS. 9A-9D, the flange 34 and the protrusions 33 form a pair of axial stops for the metal bottom plate 32. It will be appreciated, however, that in other embodiments either the flange 34 or the protrusions 33 may be omitted so that only a single axial stop is provided. Generally, the end plate assembly may have a circular contour. It will be appreciated, however, the end plate assembly may have other contours (e.g., a hexagonal contour, an octagonal contour, a rectangular contour, etc.). The metal bottom plate 32 may be mounted at the bottom of the dielectric cover member 31. It will be appreciated, however, the dielectric cover member 31 may have an increased height and the metal bottom plate 32 may be mounted in an axially intermediate area of the dielectric cover member 31. The dielectric cover member 31 and the metal bottom plate 32 may be two separate parts connected to each other by fastening elements. It will be appreciated, however, the dielectric cover member 31 and the bottom plate 32 may be permanently connected integrally by injection molding.

Figure 13:
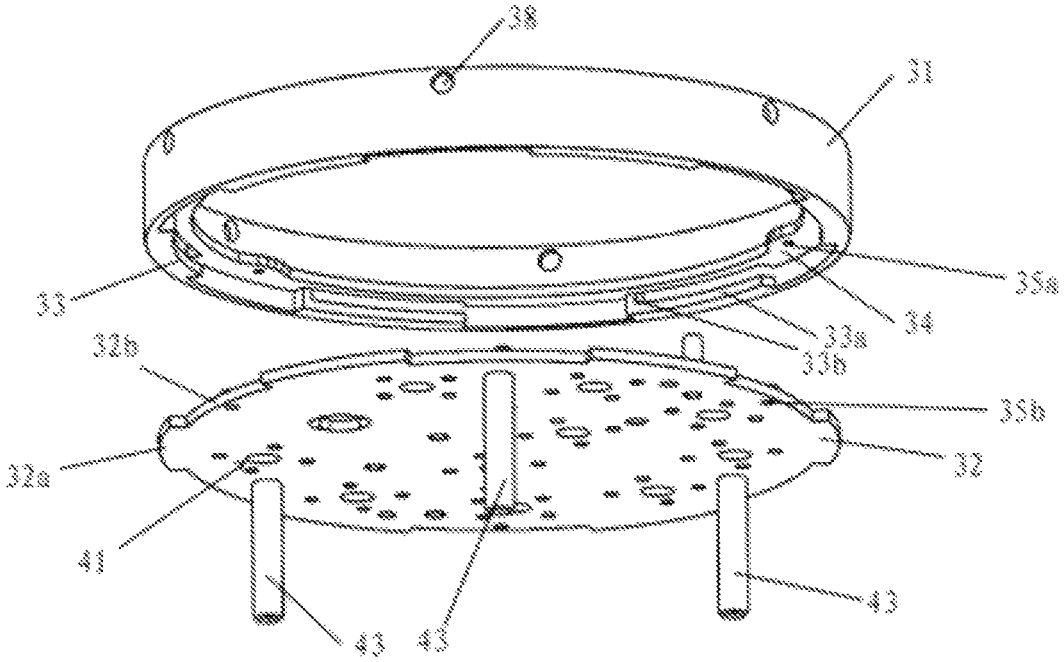
FIG. 13 is a perspective exploded view of an end plate assembly according to still further embodiments of the present invention.

FIG. 13 is a perspective exploded view of an end plate assembly according to other embodiments. The embodiment of FIG. 13 differs from the embodiment of FIGS. 9A to 9D mainly in that the flange 34 and the protrusions 33 of the dielectric cover member 31 are interchanged in position, and the bottom plate 32 can be mounted from below the bottom of the dielectric cover member to be between the flange 34 and the protrusions 33. In other respects, reference may be made to the description of the embodiments according to FIGS. 9A-9D.

The conventional integral metal end plate that are currently in use are formed by deep drawing a sheet metal. If the sheet metal has a relatively large thickness, it is very hard to perform deep drawing, and it is possible that there is a high rejection rate. For the metal bottom plate of the end plate assembly according to the present invention, a deep drawing process is not required, and the metal bottom plate may have a relatively large thickness.

It will be understood that, the terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprise" and "include" (and variants thereof), when used in this specification, specify the presence of stated operations, elements, and/or components, but do not preclude the presence or addition of one or more other operations, elements, components, and/or groups thereof. As used herein, the term "and/or" includes any and all combinations of one or more of the associated listed items. Like reference numbers signify like elements throughout the description of the figures.

The thicknesses of elements in the drawings may be exaggerated for the sake of clarity. Further, it will be understood that when an element is referred to as being "on," "coupled to" or "connected to" another element, the element may be formed directly on, coupled to or connected to the other element, or there may be one or more intervening elements therebetween. In contrast, terms such as "directly on," "directly coupled to" and "directly connected to," when used herein, indicate that no intervening elements are present. Other words used to describe the relationship between elements should be interpreted in a like fashion (i.e., "between" versus "directly between", "attached" versus "directly attached," "adjacent" versus "directly adjacent", etc.).

Terms such as "top," "bottom," "upper," "lower," "above," "below," and the like are used herein to describe the relationship of one element, layer or region to another element, layer or region as illustrated in the figures. It will be understood that these terms are intended to encompass different orientations of the device in addition to the orientation depicted in the figures.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

It will also be appreciated that all example embodiments disclosed herein can be combined in any way.

Finally, it is to be noted that, the above-described embodiments are merely for understanding the present invention but not constitute limits on the protection scope of the present invention. For those skilled in the art, modifications may be made on the basis of the above-described embodiments, and these modifications do not depart from the protection scope of the present invention.

That which is claimed is:

1. An end plate assembly for a base station antenna that includes a radome, comprising:

an end plate configured to enclose an end opening of the radome;

a first fitting; and a first connecting element, wherein the end plate is an integral dielectric member that includes an external surface, an internal surface that is opposite the external surface, and a plurality of through holes extending from the external surface to the internal surface, and wherein the first fitting has a first section that is configured to rest on the internal surface of the end plate, and the first connecting element is configured to pass through a first of the plurality of through holes and connect the first section of the first fitting to an external mounting bracket.

2. The end plate assembly according to claim 1, wherein the first fitting has a connecting section that is configured to mount the end plate assembly in the end opening of the radome.

3. The end plate assembly according to claim 1, wherein the first fitting is a metal member or a fiberglass reinforced plastic member.

4. The end plate assembly according to claim 1, wherein the end plate comprises fiberglass reinforced plastic.

5. The end plate assembly according to claim 1, wherein the end plate has a peripheral wall that includes a notch, and the first fitting is disposed in the notch.

6. An end plate assembly for a base station antenna, the end plate assembly comprising:

an end plate configured to enclose an end opening of a radome of the base station antenna, the end plate comprising an integral dielectric member that includes a bottom plate having an external surface and an internal surface, a peripheral wall extending from the bottom plate that includes a notch, and a plurality of through holes extending through the bottom plate; and a first fitting that is disposed in the notch.

7. The end plate assembly according to claim 6, wherein the first fitting includes a first section that is attached to the bottom plate and a second section that is attached to the radome.

8. The end plate assembly according to claim 6, wherein the endplate assembly further comprises a first connecting element that extends through a first of the plurality of through holes to connect the first fitting to an external mounting bracket for the base station antenna.

9. The end plate assembly according to claim 8, wherein a second of the plurality of through holes is configured to receive a second connecting element for mounting a reflector of the base station antenna on the internal surface of the end plate.

10. The end plate assembly for a base station antenna according to claim 9, wherein the end plate assembly further includes a second fitting having a planar section, wherein the planar section of the second fitting is configured to planarly rest against the internal surface of the end plate, the second connecting element is configured to pass through the second of the plurality of through holes and mount the planar section of the second fitting on the internal surface of the end plate, and the second fitting has a connecting section for connection with the reflector.

11. The end plate assembly according to claim 6, wherein the first fitting is a metal member or a fiberglass reinforced plastic member and the end plate comprises fiberglass reinforced plastic.

12. An end plate assembly for a base station antenna, the end plate assembly comprising:

a dielectric end plate that is configured to enclose an end opening of a radome of the base station antenna, the dielectric end plate including a bottom plate having an external surface and an internal surface and a plurality of through holes extending through the bottom plate;

a first fitting;

a first connecting element;

a second fitting; and a second connecting element, wherein the first fitting is attached to the dielectric end plate via the first connecting element, the first fitting including a connecting section that is configured to mount the end plate assembly in the end opening of the radome, and wherein the second connecting element is attached to the dielectric end plate via the second connecting, the second fitting including a connecting section that is configured to mount a reflector on the internal surface of the bottom plate.

13. The end plate assembly according to claim 12, wherein the first fitting is a metal member or a fiberglass reinforced plastic member.

14. The end plate assembly according to claim 12, wherein the dielectric end plate comprises fiberglass reinforced plastic.

15. The end plate assembly according to claim 12, wherein the end plate has a peripheral wall that includes a notch, and the first fitting is disposed in the notch.

16. The end plate assembly according to claim 12, wherein the first connecting element extends through a first of the plurality of through holes to connect the first fitting to an external mounting bracket for the base station antenna.

17. The end plate assembly for a base station antenna according to claim 16, wherein a planar section of the first fitting has a through hole, and the mounting bracket has a hole with an internal thread, wherein the first connecting element is configured to pass through the through hole of the first fitting and the first of the plurality of through holes of the end plate and engage the internal thread of the hole of the mounting bracket.

18. The end plate assembly for a base station antenna according to claim 17, wherein the first fitting has an L shape.

19. The end plate assembly for a base station antenna according to claim 18, wherein the first connecting element is a screw.

* * * * *